US008997706B2

(12) United States Patent
Stolk et al.

(10) Patent No.: US 8,997,706 B2
(45) Date of Patent: Apr. 7, 2015

(54) INTERNAL COMBUSTION ENGINE VALVE ACTUATION CONTROL ARRANGEMENT

(71) Applicant: Daimler AG, Stuttgart (DE)

(72) Inventors: Thomas Stolk, Kirchheim, DE (US); Alexander Von Gaisberg-Helfenberg, Beilstein, DE (US)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 13/952,634

(22) Filed: Jul. 28, 2013

(65) Prior Publication Data

US 2013/0306014 A1 Nov. 21, 2013

Related U.S. Application Data

(63) Continuation-in-part of application No. PCT/EP2011/006068, filed on Dec. 3, 2011.

(30) Foreign Application Priority Data

Feb. 17, 2011 (DE) ..... 10 2011 011 456

(51) Int. Cl.

| | |
|---|---|
| ***F01L 1/34*** | (2006.01) |
| ***F01L 13/00*** | (2006.01) |
| *F01L 1/047* | (2006.01) |

(52) U.S. Cl.
CPC ..... *F01L 1/34* (2013.01); *F01L 13/0036* (2013.01); *F01L 2001/0473* (2013.01); *F01L 2013/0052* (2013.01)

(58) Field of Classification Search
USPC ..... 123/90.16, 90.18, 90.6; 29/888.1
See application file for complete search history.

(56) References Cited

U.S. PATENT DOCUMENTS 8,307,794 B2 * 11/2012 Lengfeld et al. ..... 123/90.15

FOREIGN PATENT DOCUMENTS

| | | |
|---|---|---|
| DE | 10 2004 021 375 | 1/2006 |
| DE | 10 2007 052 251 | 5/2009 |
| DE | 10 2007 054 977 | 5/2009 |
| DE | 2008 064 340 | 6/2010 |
| JP | 2010 096102 | 4/2010 |
| WO | WO 2009021667 A1 * | 2/2009 |

* cited by examiner

*Primary Examiner* — Ching Chang
(74) *Attorney, Agent, or Firm* — Klaus J. Bach

(57) ABSTRACT

In an internal combustion engine a valve actuation control arrangement is provided, which has at least three independently axially displaceable cam elements and a switch gate which has at least one continuous gate track for displacing the at least three cam elements sequentially one after the other.

9 Claims, 8 Drawing Sheets

INTERNAL COMBUSTION ENGINE VALVE ACTUATION CONTROL ARRANGEMENT

This is a continuation-in-part application of pending international patent application PCT/EP2011/006068 filed Dec. 3, 2011 and claiming the priority of German patent application 10 2011 011 456.4 filed Feb. 17, 2011.

BACKGROUND OF THE INVENTION

The invention relates to a valve actuation control arrangement for an internal combustion engine including a cam shaft with axially movable cam elements.

An internal combustion engine valve train device having independently axially displaceable can elements and having a switch gate for displacing the cam elements is already known from DE 10 2004 021 375 A1.

It is the principal object of the invention to provide an economical internal combustion engine valve actuation control arrangement for an internal combustion engine including a camshaft having more than two cam elements which are to be independently switched.

SUMMARY OF THE INVENTION

In an internal combustion engine valve actuation control arrangement is provided, which has at least three independently axially displaceable cam elements, and a switch gate which has at least one continuous gate track for sequentially displacing the at least three cam elements sequentially one after the other.

A switchable valve actuation control arrangement is thus be provided for an internal combustion engine which has at least three cylinders which are arranged in a row and which have different valve activation times, such as in particular for an internal combustion engine designed as a three-cylinder in-line engine and/or for an internal combustion engine in the form of a six-cylinder V-type engine.

A "switch gate" is understood to mean a switching unit for axially displacing the at least three cam elements, which has at least one gate track that is provided for converting a rotary motion into an axial adjusting motion. A "gate track" is understood in particular to mean a track for forced guidance on one or both sides of a switch pin. The gate track is preferably designed in the form of a web, in the form of a slot, and/or in the form of a groove. The switch pin is preferably designed in the form of a shifting shoe which surrounds the web, in the form of a pin which engages in the slot, and/or in the form of a pin which is guided in the groove. A "continuous gate track" is understood in particular to mean a gate track by means of which the switch pin is always forcibly guided. A "cam element" is understood in particular to mean a support element provided with cams. The cams are preferably designed in one piece with the cam element; i.e., the cam element forms the support element and the cams in one piece. However, it is also conceivable in principle for the cams to be separate from the support element and to be fixedly connected to the support element. The term "provided" is understood in particular to mean specially equipped and/or designed. The term "sequentially one after the other" is understood in particular to mean that the cam elements are displaced one after the other in individual steps in a switching operation.

It is further proposed that the at least one gate track has at least three switching segments, each of which is associated with one of the cam elements. The sequential displacement of the cam elements may thus be achieved in a particularly simple manner. A "switching segment" is understood in particular to mean a segment of the gate track which has at least one axial inclination. An "axial inclination" is understood in particular to mean that the gate track in this segment has an inclination by which a progression of the gate track axially deviates from a circular line about a main rotational axis of the at least three cam elements, as the result of which a rotary motion of a camshaft may be converted into an axially acting force. Here, and also where not stated otherwise, the main rotational axis of the camshaft is defined as a reference for the directional indications "axial," "in the peripheral direction," and "radial." The term "associated with a cam element" is understood in particular to mean that the switching segment is provided for switching the corresponding cam element.

Two of the cam elements in each case preferably form a portion of the at least one gate track. The gate track may thus have a particularly simple design. In the present context, "form" is understood in particular to mean that the gate track is designed in one piece with the cam element, such as in particular in the form of a groove that is formed into the two cam elements.

It is particularly advantageous when the cam elements, each of which includes a portion of the at least one gate track, in each case has an angular range of approximately 120 degrees camshaft angle, at least in one area of the switch gate. The gate track may thus have a particularly advantageous design. An area of the switch gates is understood in particular to mean an axial area of the camshaft which includes the at least one gate track. An "angular range" is understood in particular to mean an extension of the cam element in the peripheral direction. A degree indication in "degrees camshaft angle" is understood in particular to mean the degree indication based on the camshaft; i.e., one revolution of the camshaft corresponds to 360 degrees camshaft angle. In contrast, "degrees crankshaft angle" is understood to mean an angular indication based on a crankshaft, whereby in this angular indication one revolution of the camshaft corresponds to 720 degrees crankshaft angle. The gate track preferably has a length of at least 330 degrees camshaft angle. The term "approximately" is understood in particular to mean an accuracy of ±5 degrees camshaft angle, whereby ±2 degrees camshaft angle is advantageous and ±1 degrees camshaft angle is particularly advantageous.

It is further proposed that the at least one gate track has a length of at least 360 degrees camshaft angle. A particularly advantageous extension of the switching segments over the gate track may thus be achieved. In particular, it is thus possible for all switching segments to have a length of at least 90 degrees camshaft angle, whereby a length of at least 100 degrees camshaft angle is advantageous and a length of approximately 110 degrees camshaft angle is particularly advantageous.

It is further proposed that the internal combustion engine valve train device has a gate element which forms a part of the at least one gate track. The third cam element, which preferably has no gate track, may thus advantageously be activated by means of the switch gate.

The gate element particularly advantageously has an angular range of approximately 120 degrees, at least in the area of the switch gate. The gate element may thus be inserted between the cam elements in a particularly advantageous manner. The gate element and the at least two cam elements preferably directly adjoin one another, i.e., merge into one another in the peripheral direction in a practically gap-free manner.

It is further proposed that the internal combustion engine valve train device has a connecting unit which couples one of the cam elements and the gate element to one another in a movable manner. The third cam element may thus be situated at a distance from the switch gate, thus allowing a structurally simple design of the switch gate. The term "coupled in a movable manner" is understood in particular to mean connected to one another in a rotationally fixed and axially fixed manner.

In one particularly advantageous embodiment of the invention, the at least one gate track has an engagement or meshing segment which is in the form of one piece with at least one of the switching segments. A length of the gate track may thus be particularly short, so that the gate track may have include at least three switching segments. A "meshing segment" is understood in particular to mean a segment of the gate track which has at least one radial inclination. A "radial inclination" is understood in particular to mean that the gate track in this segment has an inclination by which a progression of the gate track radially deviates from a circular line about the main rotational axis of the at least three cam elements, as the result of which a rotary motion of the camshaft may be converted into a radially acting force. The gate track has a varying depth and/or height in the meshing segment, by means of which the switch pin may be meshed into the gate track. In the present context, "one-piece" is understood in particular to mean that the gate track has a radial inclination and an axial inclination at least in a partial area, i.e., is inclined with respect to the peripheral direction in the axial direction and in the radial direction, so that an axial action of force is still effective on the corresponding cam element during meshing of the switch pin into the gate track.

Alternatively and/or additionally, the at least one gate track may have a demeshing segment which is designed, at least partly, in one piece with at least one of the switching segments. The length of the gate track may be further shortened in this way, so that a particularly advantageous design may be achieved. A "demeshing segment" is understood to mean a further segment of the gate track which has at least one radial inclination, whereby the switch pin is moved out of the switch gate and disengaged from the gate track.

In addition, it is proposed that the internal combustion engine valve train device has a second gate track which is essentially situated in a phase-shifted manner with respect to the first gate track. A particularly small installation space requirement may thus be achieved for the switch gate. The term "phase-shifted" is understood in particular to mean that the first gate track and the second gate track are offset relative to one another along a peripheral direction of the camshaft. A peripheral direction is understood to mean a direction that is oriented tangentially with respect to a circular arc about the main rotational axis of the camshaft in a direction of rotation provided for the camshaft.

Furthermore, it is proposed that the internal combustion engine valve train device includes a switching unit which has only one switch pin for each switching direction, and which is provided for displacing all cam elements in the appropriate switching direction by means of the switch gate. The internal combustion engine valve train device may thus have a particularly economical design, since the number of components, in particular the number of actuators for the switch pins, may be kept small.

The invention will become more readily apparent from the following description with reference to the accompanying drawings in which an exemplary embodiment of the invention is illustrated. The drawings, the description, and the claims contain numerous features in combination. Those skilled in the art will also advantageously consider the features individually and combine them into further meaningful combinations.

DESCRIPTION OF AN EXEMPLARY EMBODIMENT

Figure 1:
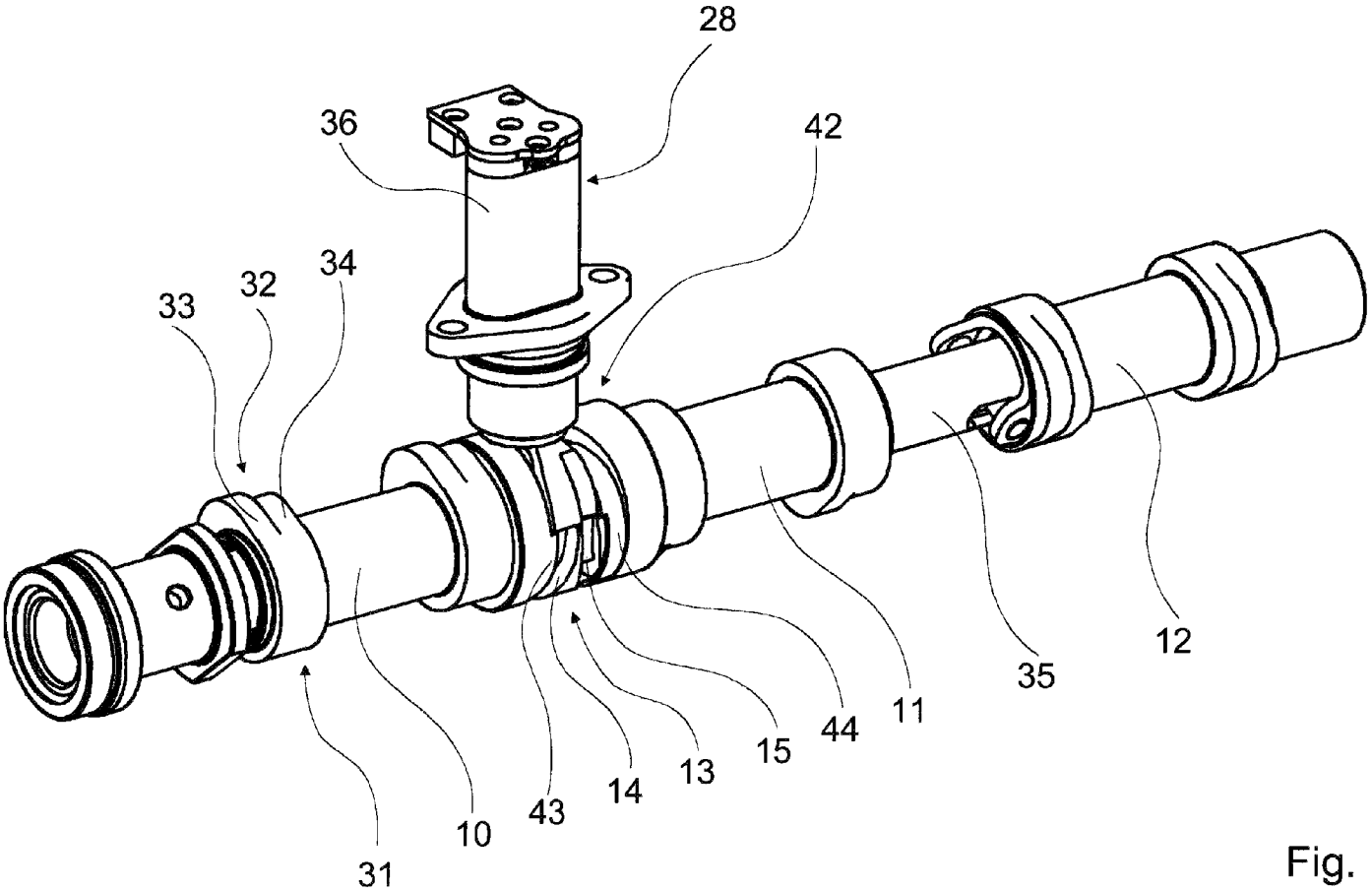
FIG. 1 shows an internal combustion engine valve train device according to the invention in a perspective top view.

FIGS. 1 through 14 show an internal combustion engine valve train device according to the invention. The internal combustion engine valve train device is provided for an internal combustion engine having three cylinders arranged in a row which have different valve activation times. The internal combustion engine valve train device may be used for an internal combustion engine in which only three cylinders are arranged in a row, such as for an in-line engine having three cylinders or a V engine having six cylinders, for example. However, the internal combustion engine valve train device is also usable for an internal combustion engine in which six cylinders are arranged in a row, each having the same or at least similar valve activation times in pairs, such as, for example, in an in-line engine having six cylinders in which in each case adjacent cylinders have the same or at least similar valve activation times.

The internal combustion engine valve train device includes a camshaft 31 having three cam elements 10, 11, 12. The cam elements 10, 11, 12 are designed as cam supports. At least one cam 32, having two partial cams 33, 34 with different valve activation curves, is situated on each of the cam elements 10, 11, 12. The partial cams 33, 34 of one of the cams 32 are each situated directly adjacent to one another. The cam elements 10, 11, 12 are axially displaceable. A switch is made inside the cam 32 from one partial cam 33 to the other partial cam 34 by means of an axial displacement of one of the cam elements 10, 11, 12. Thus, each of the cam elements 10, 11, 12 has two discrete switching positions in which a different valve lift is switched for the cylinder(s) associated with the corresponding cam element 10, 11, 12.

The camshaft 31 has a drive shaft 35 for mounting of the cam elements 10, 11, 12. The drive shaft 35 includes a crankshaft connection for connection to a crankshaft, not illustrated in greater detail. The crankshaft connection may be provided via a camshaft adjuster which is provided for setting a phase position between the camshaft 31 and the crankshaft.

The cam elements 10, 11, 12 are axially displaceable on the drive shaft 35 in a rotationally fixed manner. The drive shaft 35 has spur toothing on its outer periphery. The cam elements 10, 11, 12 have corresponding spur toothing on their inner periphery which engages with the spur toothing of the drive shaft 35.

In addition, the internal combustion engine valve train device includes a switch gate 13. The switch gate 13 is provided for sequentially displacing the three cam elements 10, 11, 12 one after the other in a switching operation. The switch gate 13 includes two gate tracks 14, 15 for displacing the cam elements 10, 11, 12. The first gate track 14 is provided for displacing the cam elements 10, 11, 12 in a first switching direction from the first switching position into the second switching position (see FIGS. 5 through 9). The second gate track 15 is provided for displacing the cam elements in a second switching direction from the second switching position into the first switching position (see FIGS. 10 through 14).

Furthermore, the internal combustion engine valve train device includes a switching unit 28 which has switch pins 29, 30 for engaging with the gate tracks 14, 15, respectively. The switching unit 28 has a stator housing 36 which is fixedly connected to an engine block, not illustrated in greater detail, of the internal combustion engine. The switch pins 29, 30 are situated in the stator housing 36 so as to be displaceable along their main direction of extension. The gate tracks 14, 15 are designed as grooves in which the switch pins 29, 30, respectively, may be forcibly guided at least partially on both sides. During a switching operation in the first switching direction, the first switch pin 29 is brought into engagement with the first gate track 14. During a switching operation in the second switching direction, the second switch pin 30 is brought into engagement with the second gate track 15.

The gate tracks 14, 15 have a plurality of switching segments 16, 17, 18, 19, 20, 21. The first gate track 14 includes the three switching segments 16, 17, 18, which are provided for switching the three cam elements 10, 11, 12 in the first switching direction. The switching segments 16, 17, 18 are each associated with exactly one of the cam elements 10, 11, 12. The gate track 14 also includes a meshing segment 24 and a demeshing segment 26. The second gate track 15 has an analogous design. The second gate track 15 includes the three switching segments 19, 20, 21, a meshing segment 25, and a demeshing segment 27.

The switching segments 16, 17, 18, 19, 20, 21 each have an axial inclination. Due to the axial inclination, the cam element 10, 11, 12 which is associated with the corresponding switching segment 16, 17, 18, 19, 20, 21 is displaced when the corresponding switch pin 29, 30 is engaged with the corresponding switching segment 16, 17, 18, 19, 20, 21. The meshing segments 24, 25 have a radial inclination. The gate tracks 14, 15, which are designed as grooves, have a continuously increasing depth in one area of the meshing segments 24, 25. The corresponding gate track 14, 15 has an essentially constant depth in an area situated between the meshing segment 24, 25 and the demeshing segment 26, 27. The corresponding gate track 14, 15 has a continuously decreasing depth in the area of the demeshing segments 26, 27.

Each of the two gate tracks 14, 15 is continuous; i.e., the switch pin 29, 30 brought into engagement with the gate track 14, 15, respectively, via the corresponding meshing segment 26, 27 runs in succession through the switching segments 16, 17, 18, 19, 20, 21 of the corresponding gate track 14, 15 before the switch pin 29, 30 is again released from the gate track 14, 15 by means of the demeshing segment 26, 27. The cam elements 10, 11, 12 are thus sequentially switched one after the other. In a switching operation along the first switching direction, first the axially outer cam element, 10, then the axially middle cam element 11, and lastly the axially outer cam element 12 is switched. In a switching operation along the second switching direction, first the axially middle cam element 11, then the axially outer cam element 12, and lastly the axially outer cam element 10 is displaced. Thus, the two switching operations are not symmetrical with respect to a switching sequence of the elements 10, 11, 12.

The switch gate 13 is situated in an area of the camshaft 31 in which the axially outer cam element 10 and the axially middle cam element 11 adjoin one another. In this area the two cam elements 10, 11 have only an angular range of 120 degrees camshaft angle in each case. In addition, the internal combustion engine valve train device has a gate element 22 which is situated in the area of the camshaft 31 in which the cam elements 10, 11 adjoin one another. The gate element 22 likewise has an angular range of 120 degrees camshaft angle. In the area of the switch gate 13, the two cam elements 10, 11 and the gate element 22 thus have approximately equal angular ranges. Thus, in a rotation of the camshaft 31 by 360 degrees camshaft angle, the cam element 10, the cam element 11, and the gate element 22, face the switching unit 28 in succession.

The two cam elements 10, 11 and the gate element 22 form the gate tracks 14, 15. The gate tracks 14, 15, which are designed as grooves, are introduced directly into the cam elements 10, 11 and the gate element 22. The two cam elements 10, 11 and the gate element 22 in each case form a portion of the gate track 14, 15. However, it is also conceivable in principle to provide further gate elements for the switch gate 13 instead of the cam elements 10, 11, the further gate elements being coupled to the cam elements 10, 11 in a movable manner.

The meshing segment 24 of the gate track 14 starts on the gate element 22 and ends on the axially outer cam element 10. The first switching segment 16 of the gate track 14 is situated on the axially outer cam element 10. The second switching segment 17 of the gate track 14 is situated on the axially middle cam element 11. The third switching segment 18 of the gate track 14 is situated on the gate element 22. The demeshing segment 26 of the gate track 14 extends from the gate element 22 to the axially outer cam element 10. The gate track 14 thus extends over an angle that is larger than 360 degrees camshaft angle.

The meshing segment 25 of the gate track 15 starts on the axially outer cam element 10 and ends on the axially middle cam element 11. The first switching segment 19 of the gate track 15 is situated on the axially middle cam element 11. The second switching segment 20 of the gate track 15 is situated on the gate element 22. The third switching segment 21 of the gate track 15 is situated on the axially outer cam element 10. The demeshing segment 27 of the gate track 15 extends from the axially outer cam element 10 to the middle cam element 11. The gate track 15 thus likewise extends over an angle that is larger than 360 degrees camshaft angle.

Figure 2:
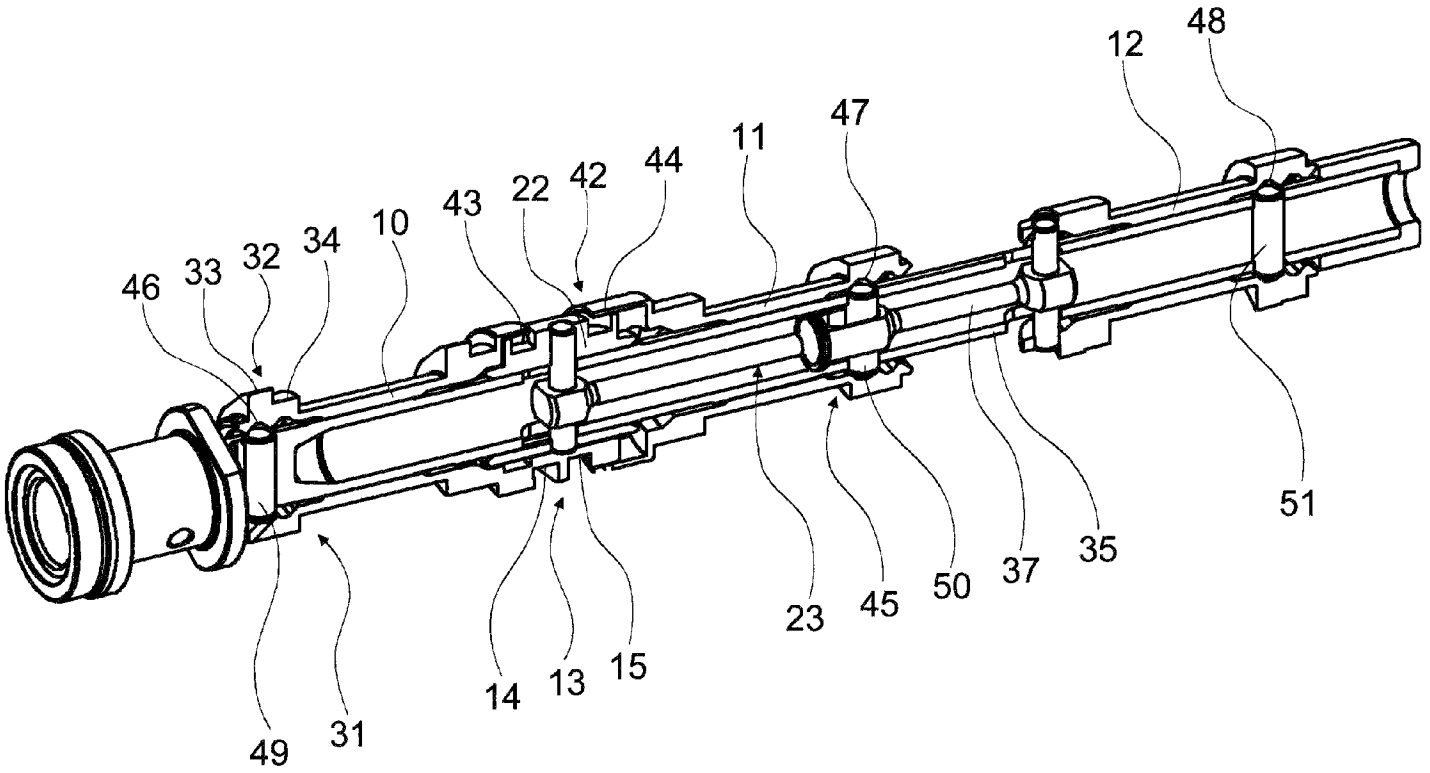
FIG. 2 shows the internal combustion engine valve train device partially cut away longitudinally.

The gate element 22 and the axially outer cam element 12 are coupled to one another in a movable manner (see FIG. 2). The drive shaft 35 is designed, at least in part, as a hollow shaft. The internal combustion engine valve train device includes a connecting unit 23 which couples the gate element 22 to the cam element 12. The connecting unit 23 includes a coupling rod 37 which is guided in the drive shaft 35. The drive shaft 35 includes a first opening through which the coupling rod 37 is coupled to the gate element 22, and a second opening through which the coupling rod 37 is coupled to the cam element 12. The cam element 12 is thus coupled to an axial motion of the gate element 22 in an at least practically rigid manner. The cam element 12 and the gate element 22 are connected to one another in a rotationally fixed manner via the drive shaft 35.

The first gate track 14 is provided for an adjustment of the cam elements 10, 11, 12 in the first switching direction. The second gate track 15 is situated in a mirror image with respect to the first gate track 14 and phase-shifted relative to same. Thus, the structure of the second gate track 15 corresponds to that of the first gate track 14, A difference between the two gate tracks 14, 15 is that the axial inclination of the switching segments 19, 20, 21 of the second gate track 15 is directed oppositely with respect to the axial inclination of the switching segments 16, 17, 18 of the first gate track 14. In addition, a start of the second gate track 15 is phase-shifted with respect to a start of the first gate track 14. Thus, due to the structural similarities, in particular the first gate track 14 is described below; a description of the first gate track 14, taking into account the phase offset, in principle is analogously applicable to the second gate track 15.

The meshing segment 24 of the gate track 14 and the first switching segment 16 are partially designed in one piece. The gate track 14 has an axial inclination and a radial inclination in an area in which the meshing segment 24 and the switching segment 16 are designed in one piece. In addition, the demeshing segment 26 and the switching segment 18 are partially designed in one piece. The gate track 14 likewise has an axial inclination and a radial inclination in an area in which the demeshing segment 26 and the switching segment 18 are designed in one piece.

The meshing segment 24, the switching segments 16, 18, and the demeshing segment 26 are also partially separate. Originating from a start, the gate track 14 includes an area which has solely a radial inclination. In this area, in which the gate track 14 extends in the peripheral direction and has only an increasing radial depth, the meshing segment 24 is separate from the switching segment 16. The area in which the meshing segment 24 and the switching segment 16 are separate is situated for the most part on the gate element 22.

The area in which the switching segment 16 and the meshing segment 24 are designed in one piece adjoins the area which has solely the radial inclination. The switching segment 16, and thus also the area in which the meshing segment 24 and the switching segment 16 are designed in one piece, is situated completely on the cam element 10.

An area of the gate rack 14 in which the gate track 14 has solely an axial inclination adjoins this area. The switching segment 16 and the meshing segment 24 are once again separate in this area. The gate track 14 has an approximately constant depth in this area.

The switching segment 16 is followed by a transition segment 38 in which the gate track 14 has neither a radial inclination nor an axial inclination. The transition segment 38 provides a transition from the cam element 10 to the cam element 11. The transition segment 38 is formed partly by the cam element 10. The transition segment 38 is situated between the two switching segments 16, 17.

The portion of the gate track that is situated on the cam element 11 has an essentially constant depth. The cam element 11 forms a further portion of the transition segment 38. In addition, the switching segment 17 is situated completely on the cam element 11.

For a transition between the switching segment 17 and the switching segment 18, the gate track 14 includes a further transition segment 39 which has neither a radial inclination nor an axial inclination. The further transition segment 39 adjoins the switching segment 17. The transition segment 39 is formed partly by the cam element 11 and partly by the gate element 22.

The switching segment 18 associated with the cam element 12 adjoins the transition segment 39. The gate track 14 initially has solely an axial inclination in an area which directly adjoins the transition segment 39. The switching segment 18 is initially separate from the demeshing segment 26.

In its further progression, the gate track 14 once again has an area with an axial inclination and a radial inclination. The demeshing segment 26 and the switching segment 18 are designed in one piece in this area. In the area in which the demeshing segment 26 and the switching segment 18 are designed in one piece, the gate track has a decreasing depth. This area is adjoined by an area in which the demeshing segment 26 is separate from the switching segment 18. In this latter area, the gate track 14 has solely a radial inclination. A majority of the area in which the demeshing segment 26 is separate from the switching segment 18 is formed by the cam element 10.

The switch pins 29, 30 of the switching unit 28 are respectively provided for one of the two switching directions in which the cam elements 10, 11, 12 may be displaced. The switch pin 29 provided for the first switching direction is extended in order to displace the cam elements 10, 11, 12 in the first direction. The switch pin 29 is brought into engagement with the meshing segment 24 of the first gate track 14 due to the rotary motion of the camshaft 31 (see FIG. 5). Upon further rotary motion of the camshaft 31, the switch pin 29 initially partially meshes with the gate track 14 without an axial force being exerted on one of the cam elements 10, 11, 12.

Figure 6:
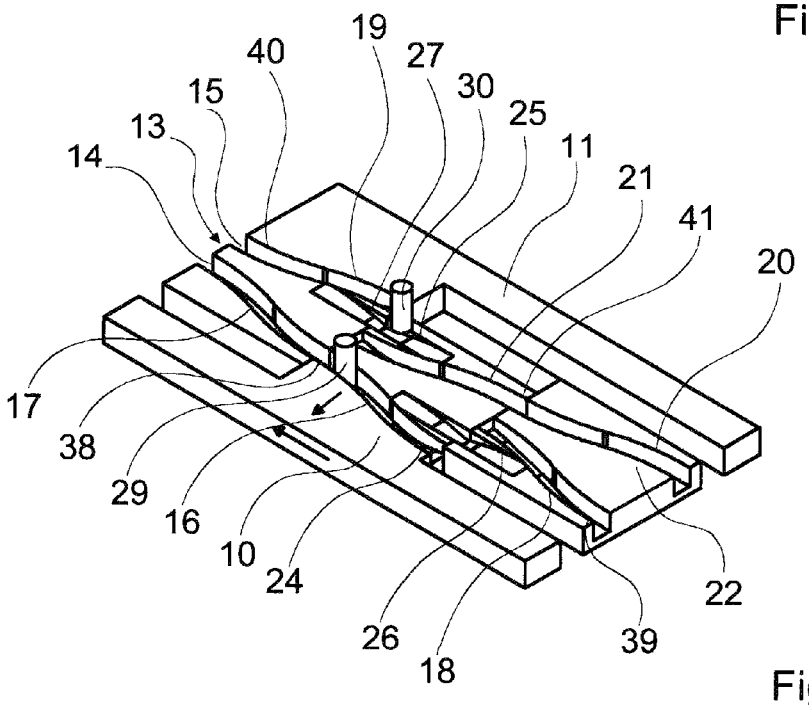

The switch pin 29 engages with the switching segment 16 due to the further rotary motion of the camshaft 31 (see FIG. 6). As a result of one-piece design of the switching segment 16 and the meshing segment 24, the switch pin 29 is also engaged with the meshing segment 24. The rotary motion of the camshaft 31 thus brings about an axial force on the cam element 10, while the switch pin 29 engages further with the gate track 14. The cam element 10 is displaced from the first switching position into the second switching position due to the engagement of the switch pin 29 with the switching segment 16 and the rotary motion of the camshaft 31.

After the switch pin 29 has completely passed through the switching segment 16, the cam element 10 is switched into the second switching position. The switch pin 29 engages with the first transition segment 38 due to the further rotary motion. As a result of the rotary motion of the camshaft 31, the switch pin 29 is transferred from a portion of the gate track 14 that is situated on the cam element 10 to the portion of the gate track 14 that is situated on the cam element 11.

Figure 7:
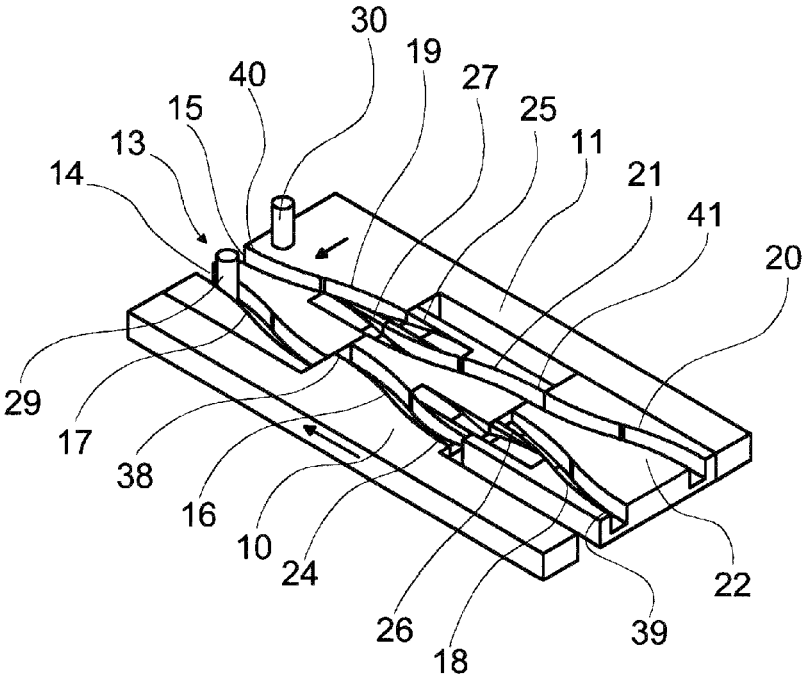
Figure 8:
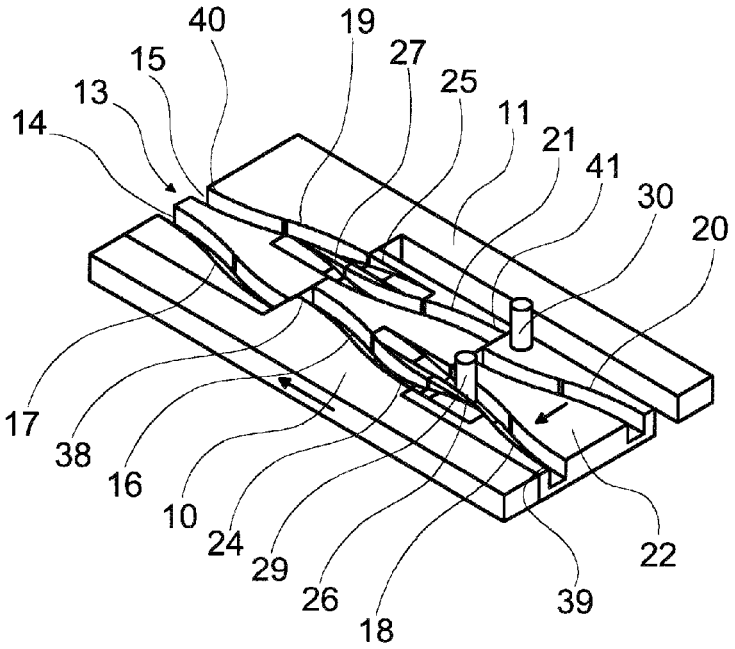
Figure 9:
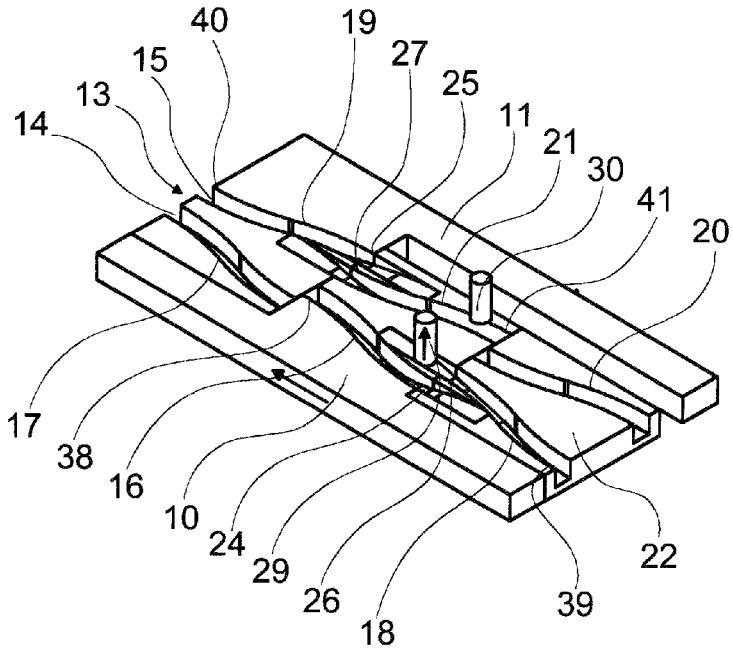
Figure 10:
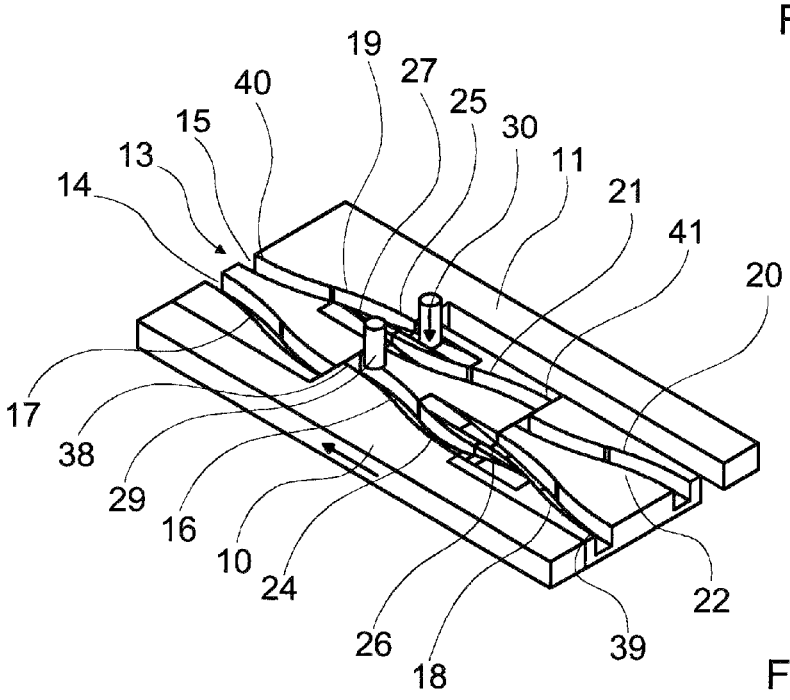
FIGS. 10-14 show a switching operation along a second switching direction.
Figure 11:
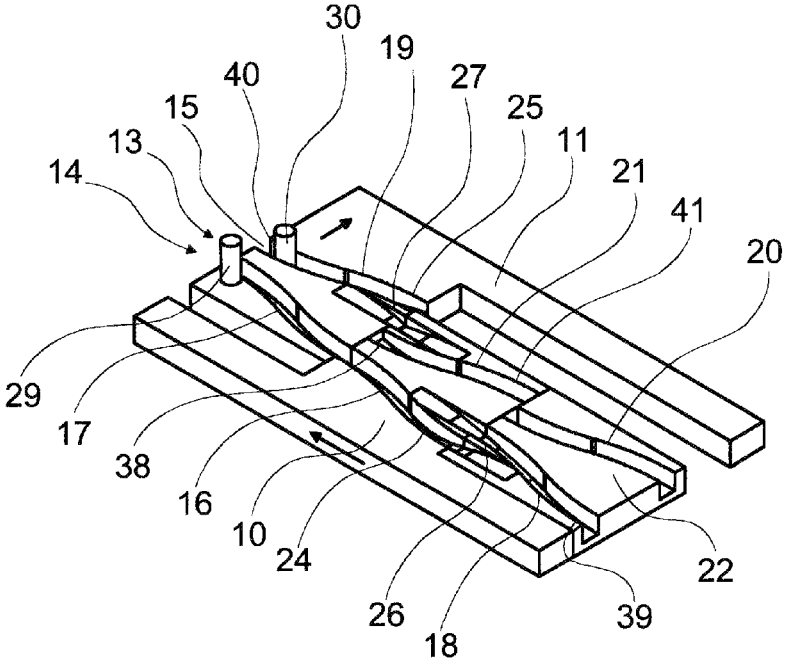
Figure 12:
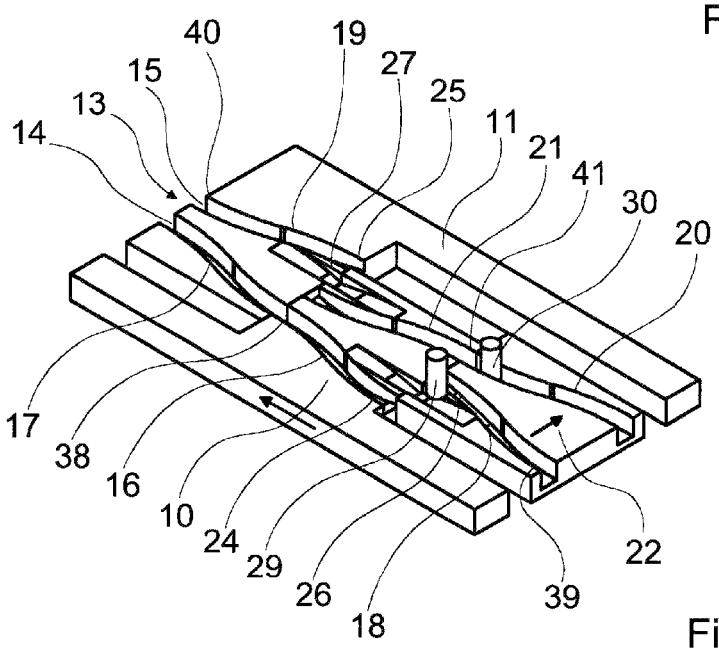
Figure 13:
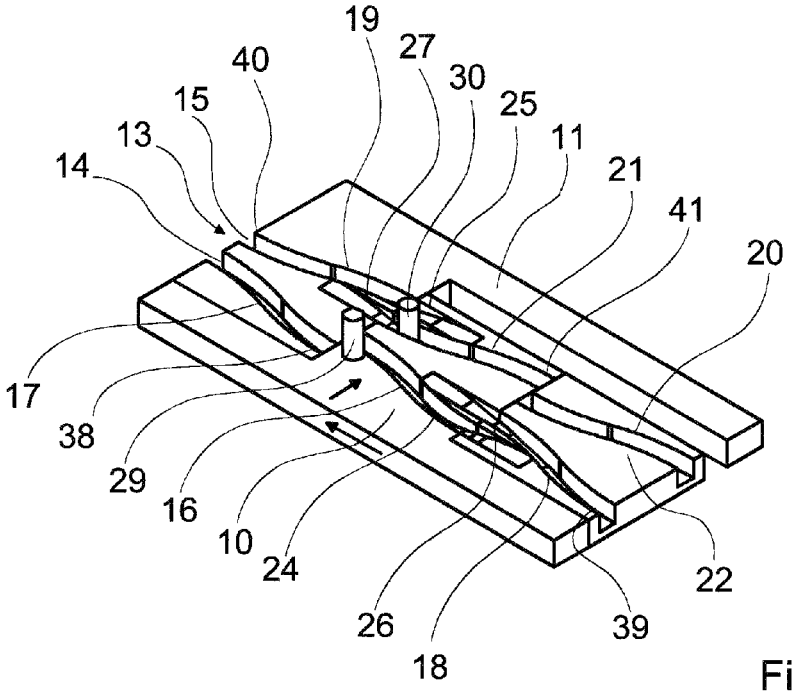
Figure 14:
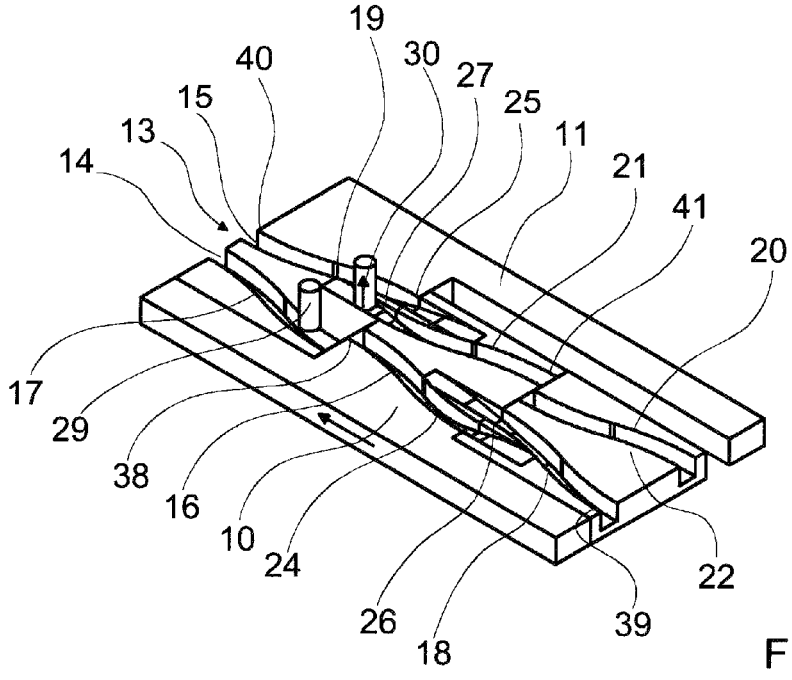

Due to the further rotary motion, the switch pin 29 becomes engaged with the switching segment 17 that is situated on the cam element 11 (see FIG. 7). The rotary motion of the camshaft 31 and the engagement of the switch pin 29 with the switching segment 17 bring about an axial force on the cam element 11 which switches the cam element 11 from the first switching position into the second switching position. After the switch pin 29 has completely passed through the switching segment 17, the cam element 11 is switched into the second switching position.

Upon further rotary motion of the camshaft 31, the switch pin 29 is transferred via the transition segment 39 from the cam element 11 to the gate element 22. The switch pin 29 thus becomes engaged with the switching segment 18 which is situated on the gate element 22 and is associated with the cam element 12.

Since the switching segment 18 is partly separate from the demeshing segment 26, the rotary motion of the camshaft 31 and the engagement of the switch pin 29 with the gate track 14 initially bring about only an axial forte on the cam element 12 while, with further rotary motion, as the switch pin 29 reaches the area in which the switching segment 18 and the demeshing segment 26 are continuous in the same piece (see FIG. 8), force acts on the cam element 12 which displaces the cam element 12 in the first switching direction.

As soon as the switch pin 29 has passed through the switching segment 18, the cam element 12 is also switched into the second switching position. The switch pin 29 is further demeshed due to the demeshing segment 26, which is also separate from the switching segment 18 (see FIG. 9). During the demeshing, the switch pin 29 is pushed into the stator housing 36 due to the rotary motion of the camshaft 31 and the radial inclination of the gate track 14. As soon as the switch pin 29 has completely passed through the demeshing segment 26, the switching operation of the cam elements 10, 11, 12 from the first switching position into the second switching position is fully complete.

A switching operation in the second switching direction by means of the second gate track 15 is carried out in an analogous manner. After the meshing into the meshing segment 25 of the gate track 15 (see FIG. 10), the switch pin 30 passes through the meshing segment 25 and the switching segment 19 (see FIG. 11). The switch pin 30 is then transferred to the subsequent switching segment 20 by means of a transition segment 40 (see FIG. 12). The switch pin 30 is transferred to the switching segment 21 by means of a transition segment 41 (see FIG. 13), and is subsequently again demeshed by means of the demeshing segment 27 (see FIG. 14).

The meshing segments 24, 25 each have an angular range of approximately 110 degrees camshaft angle. The switching segments 16, 17, 18, 19, 20, 21 each have an angular range of likewise approximately 110 degrees camshaft angle. The transition segments 38, 39, 40, 41 each have an angular range of approximately 10 degrees camshaft angle. The demeshing segments 26, 27 each have an angular range of approximately 95 degrees camshaft angle.

The meshing segment 24 and the first switching segment 16 are designed in one piece over an angular range of approximately 40 degrees camshaft angle. The last switching segment 18 and the demeshing segment 26 are likewise designed in one piece over an angular range of approximately 40 degrees camshaft angle. The second gate track 15 has an analogous design. The gate tracks 14, 15 thus each have a length of approximately 475 degrees camshaft angle. Thus, the meshing segments 24, 25 and the demeshing segments 26, 27 of the gate tracks 14, 15, respectively, are each partly axially situated next to one another.

Figure 3:
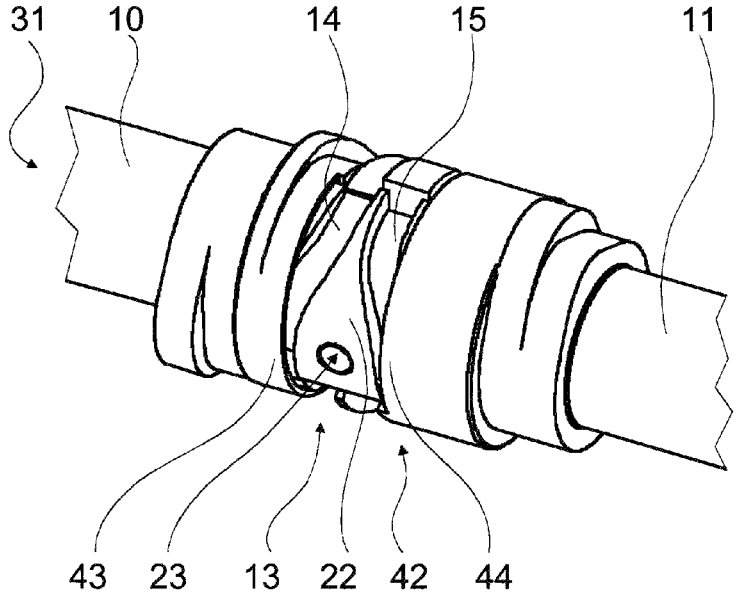
FIG. 3 shows a switch gate of the internal combustion engine valve train device.
Figure 4:
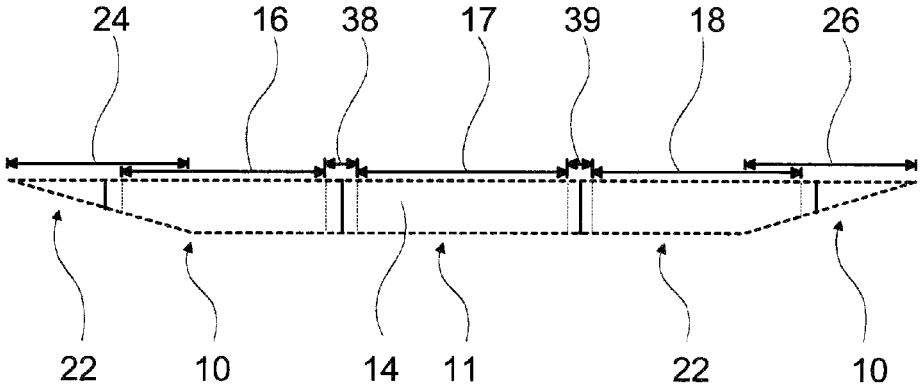
FIG. 4 shows a gate track of the switch gate in a schematic illustration.
Figure 5:
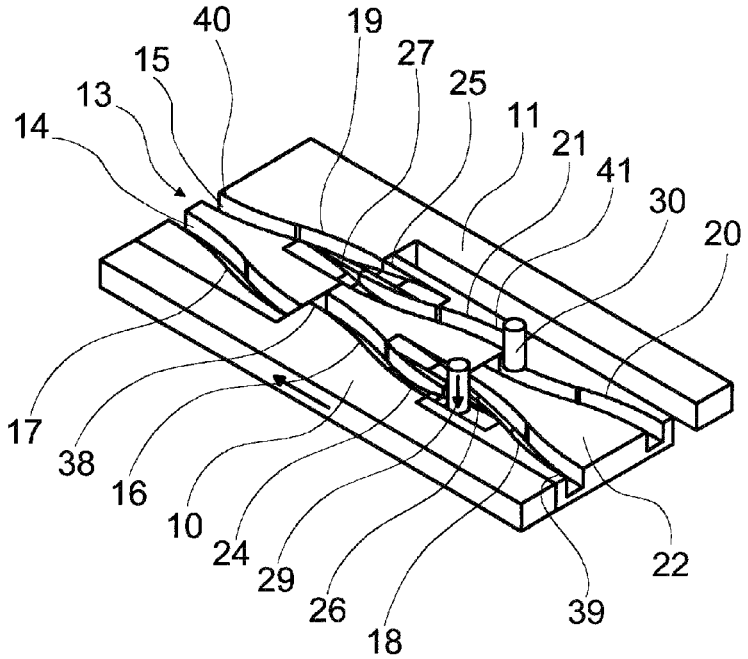
FIGS. 5-9 show a switching operation along a first switching direction.

To prevent improper meshing of the switch pins 29, 30 directly into one of the switching segments 16, 17, 18, 19, 20 while skipping the corresponding meshing segment 24, 25, the internal combustion engine valve train unit has a cover unit 42 (see FIG. 3). The cover unit 42 is provided for covering unused parts of the gate tracks 14, 15.

For partially covering the first gate track 14, the cover unit 42 includes a first cover element 43 which is fixedly connected to the cam element 10 which forms the meshing segment 24. The switching segment 17 of the second cam element 11 and the switching segment 18 of the gate element 22 are covered by the cover element 43 in an operating state in which the cam elements 10, 11, 12 are in one of the switching positions. The meshing segment 24 and the switching segment 16 of the first cam element 10 are open. The cover element 43, which is coupled to the first cam element 10, releases the switching segment 17 of the second cam element 11 and the switching segment 18 of the gate element 22 due to the displacement of the first cam element 10 by means of the first switching segment 16. The switch pin 29 may thus mesh with the gate track 14 solely via the portion of the gate track 14, situated on the first cam element 10, into the portions of the gate track 14 situated on the second cam element 11 and the gate element 22.

The cover unit 42 includes a second cover element 44 for partially covering the second gate track 15. The second cover element 44 has a design that is analogous to the first cover element 43. Both cover elements 43, 44 are designed in the form of a sleeve, which in the appropriate switching position encloses the parts of the switch gate 13, and thus partially covers the gate tracks 14, 15. The cover elements 43, 44 have an angular range of approximately 240 degrees camshaft angle. The meshing segments 24, 25 are partially introduced into the cover elements 43, 44.

The switching unit 28 has a bistable design. The two switch pins 29, 30 may remain in an unactivated state in an extended switching position and also in a retracted switching position. The switch pins 29, 30 have an unstable middle position. If one of the switch pins 29, 30 is in a position between the extended switching position and the middle position, the corresponding switch pin 29, 30 automatically switches into the extended switching position. If one of the switch pins 29, 30 is in a position between the retracted switching position and the middle position, the corresponding switch pin 29, 30 automatically switches into the retracted switching position.

For extending the switch pins 29, 30, the switching unit 28 includes an electrical actuator unit by means of which a force for the extension may be exerted on the switch pins 29, 30. The switch pins 29, 30 are independently extendable. The actuator unit is provided solely for extending the switch pins 29, 30. The switch gate 13 is provided for retracting the switch pins 29, 30. During the demeshing of the switch pins 29, 30 from the corresponding gate track 14, 15, respectively, the switch pins 29, 30 are moved over the unstable middle position and automatically retract. Thus, the demeshing segments 26, 27 of the gate tracks 14, 15 are provided for retracting the switch pins 29, 30.

The internal combustion engine valve train device has a locking unit 45 for locking the cam elements 10, 11, 12 in the switching positions. The cam elements 10, 11, 12 in each case have two locking positions. The locking unit 45 includes a plurality of locking recesses 46, 47, 48 which are provided at the inner sides of the cam elements 10, 11, 12. In addition, the locking unit 45 includes a plurality of thrust pieces 49, 50, 51 which are fixedly connected to the drive shaft 35. The cam elements 10, 11, 12 are locked with respect to the drive shaft 35 by means of the thrust pieces 49, 50, 51.

A sequence in which the switch pins 29, 30 come into engagement with the cam elements 10, 11 and the gate element 22 while passing through the corresponding gate track 14, 15 may have any given design in principle. For example, it is conceivable for the gate element 22 to have a meshing segment, the cam element 11 subsequently being situated on the gate element 22, and the cam element 10 having a demeshing segment. A sequence in which the cam elements 10, 11, 12 are thus displaced is freely definable in principle.

What is claimed is:

1. An internal combustion engine valve actuation control arrangement having a hollow camshaft (31) with at least three independently axially displaceable cam elements (10, 11, 12), and a switch gate (13) disposed between a first and a second of the at least three independently axially displaceable cam elements (10, 11) with axially adjacent gate sections having at least one continuous gate track (14, 15) provided for sequentially displacing the at least three independently axially displaceable cam elements (10, 11, 12) one after the other, the switch gate (13) comprising three switch gate segments each associated with one of the at least three independently axially displaceable cam elements (10, 11, 12), the first and second independently axially displaceable cam elements (10, 11) being connected directly to, or part of, the adjacent switch gate segments and the third independently axially displaceable cam element being connected to a third switch gate section (22) by way of a connecting unit (23) extending through the hollow camshaft (31), the at least one continuous gate track (14, 15) extending in the at least three switch gate segments (16, 17, 18, 19, 20, 21), each of which is associated with one of the at least three independently axially displaceable cam elements (10, 11, 12).

2. The internal combustion engine valve actuation control arrangement according to claim 1, wherein the cam elements (10, 11), each of which forms a portion of the at least one continuous gate track (14, 15), each extending over an angular range of 120 degrees camshaft angle, at least in one area of the switch gate (13).

3. The internal combustion engine valve actuation control arrangement according to claim 1, wherein the at least one continuous gate track (14, 15) extends over 360 degrees camshaft angle.

4. The internal combustion engine valve actuation control arrangement according to claim 1, wherein the third switch gate section (22) includes a portion of the at least one continuous gate track (14, 15).

5. The internal combustion engine valve actuation control arrangement according to claim 4, wherein the third switch gate section (22) has an angular range of 120 degrees, at least in the area of the switch gate (13).

6. The internal combustion engine valve actuation control arrangement according to claim 1, wherein the at least one gate track (14, 15) has a meshing segment (24, 25) which is designed integrally with at least one of the switch segments (16, 19).

7. The internal combustion engine valve actuation control arrangement according to claim 1, wherein the at feast one gate track (14, 15) has a demeshing segment (26, 27) which is designed integrally with at least one of the switch segments (18, 21).

8. The internal combustion engine valve actuation control arrangement according to claim 1, including a second gate track (15) which is situated in a phase-shifted manner with respect to a first gate track (14).

9. The internal combustion engine valve actuation control arrangement according to claim 1, including a switching unit (28) which has only one switch pin (29, 30) for each switching direction, and which is provided for displacing all cam elements (10, 11, 12) in an appropriate switching direction by means of the switch gate (13).

* * * * *